US008736503B2

(12) United States Patent
Zaghloul et al.

(10) Patent No.: US 8,736,503 B2
(45) Date of Patent: May 27, 2014

(54) COMPACT ROTMAN LENS USING METAMATERIALS

(75) Inventors: Amir I. Zaghloul, Bethesda, MD (US); Eric D. Adler, Columbia, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 220 days.

(21) Appl. No.: 13/360,832

(22) Filed: Jan. 30, 2012

(65) Prior Publication Data

US 2013/0194052 A1 Aug. 1, 2013

(51) Int. Cl.
*H01Q 19/06* (2006.01)
*H01Q 15/02* (2006.01)

(52) U.S. Cl.
USPC ..... 343/754; 343/909; 343/911 L; 343/911 R

(58) Field of Classification Search
None
See application file for complete search history.

(56) References Cited

U.S. PATENT DOCUMENTS

| | | | | |
|---|---|---|---|---|
| 3,761,936 | A * | 9/1973 | Archer et al. | 343/754 |
| 4,288,795 | A * | 9/1981 | Shelton | 343/754 |
| 8,351,127 | B2 * | 1/2013 | Black et al. | 359/652 |
| 8,630,044 | B2 * | 1/2014 | Bowers et al. | 359/642 |
| 2008/0048921 | A1 * | 2/2008 | Rebeiz et al. | 343/754 |
| 2012/0327516 | A1 * | 12/2012 | Abbaspour-Tamijani | 359/619 |
| 2013/0002499 | A1 * | 1/2013 | Liu et al. | 343/753 |

* cited by examiner

*Primary Examiner* — Trinh Dinh
(74) *Attorney, Agent, or Firm* — Alan I. Kalb

(57) ABSTRACT

Apparatus for receiving and transmitting electromagnetic signals are disclosed herein. In some embodiments, an apparatus includes a positive refractive index (PRI) medium; a negative refractive index (NRI) medium having a first side and a second side disposed in the PRI medium; a plurality of first transmission lines, each first transmission line having a first end extending toward the first side of the NRI medium; and a plurality of second transmission lines, each second transmission line having a second end extending toward the second side of the NRI medium, wherein a plurality of electromagnetic signals travelling in a first direction, enters the PRI medium and travels along the plurality of first transmissions lines and exits into first side of the NRI medium, passes through the NRI medium and exits through the second side of the NRI medium into the PRI medium along a first one of the second transmission lines.

20 Claims, 6 Drawing Sheets

COMPACT ROTMAN LENS USING METAMATERIALS

GOVERNMENT INTEREST

Governmental Interest—The invention described herein may be manufactured, used and licensed by or for the U.S. Government.

FIELD OF INVENTION

Embodiments of the present invention generally relate to electromagnetic signal arrays and, more particularly, to apparatus for receiving and transmitting electromagnetic signals.

BACKGROUND OF THE INVENTION

A Rotman lens may be used as a time-delay beam former in an antenna array. Exemplary apparatus which may use a Rotman lens include electronically scanned antennas, vehicle-mounted satellite terminals, or the like. Exemplary systems which may include such apparatus include radar systems, satellite-on-the-move or satellite-on-the-go systems, collision avoidance systems, or the like. A conventional Rotman lens is large, which can limit its use in portable equipment and may result in high losses due to high attenuation in the lens material and scattering in the lens structure.

Therefore, the inventors have provided a more compact Rotman lens.

BRIEF SUMMARY OF THE INVENTION

Embodiments of the present invention include apparatus for receiving and transmitting electromagnetic signals. In some embodiments, an apparatus includes a positive refractive index medium; a negative refractive index medium having a first side and a second side disposed in the positive refractive index medium; a plurality of first transmission lines, each first transmission line having a first end extending toward the first side of the negative refractive index medium; and a plurality of second transmission lines, each second transmission line having a second end extending toward the second side of the negative refractive index medium, wherein a plurality of electromagnetic signals, each electromagnetic signal travelling in a first direction, enters the positive refractive index medium and travels along the plurality of first transmissions lines and exits into the first side of the negative refractive index medium, passes through the negative refractive index medium and exits through the second side of the negative refractive index medium into the positive refractive index medium along a first one of the plurality of second transmission lines.

In some embodiments, an apparatus for receiving and transmitting signals includes a first plate; a second plate; a positive refractive index medium disposed between the first and second plates; an negative refractive index medium having a first side and a second side disposed in the positive refractive index medium; a electromagnetic bandgap material disposed in the positive refractive index medium on opposing ends of the negative refractive index medium to absorb stray electromagnetic signals which enter the negative refractive index medium through the first or second side of the negative refractive index medium; a plurality of first transmission lines formed in the first plate, each first transmission line having a first end extending toward the first side of the negative refractive index medium; a plurality of first printed horns, each first printed horn coupled to a corresponding first end of one of the plurality of first transmission lines; a plurality of second transmission lines, each second transmission line having a second end extending toward the second side of the negative refractive index medium; a plurality of second printed horns, each second printed horn coupled to a corresponding second end of one of the plurality of second transmission lines, wherein a plurality of electromagnetic signals, each electromagnetic signal travelling in a first direction, enters the positive refractive index medium and travels along the pluralities of first transmissions lines and first printed horns and exits into the first side of the negative refractive index medium, passes through the negative refractive index medium and exits through the second side of the negative refractive index medium into the positive refractive index medium along a first one of the plurality of second printed horns and a corresponding first one of the plurality of second transmission lines.

In some embodiments, an electromagnetic bandgap material is disposed on opposing ends of the negative refractive index medium to absorb spilled electromagnetic signals that scatter in directions other than in the directions of the pluralities of first transmission lines and first printed horns and/or the pluralities of second transmission lines and second printed horns respectively disposed adjacent to the first and second sides of the negative refractive index medium.

Other and further embodiments of the present invention are described below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Embodiments of the present invention include apparatus for receiving and transmitting electromagnetic signals. Exemplary apparatus include an array for receiving and transmitting electromagnetic signals, such as an array structure in the form of a Rotman lens or the like. The inventive apparatus advantageously reduces the size of the array, for example, by using a negative refractive index medium for at least a portion of the dielectric medium which may be used to form the lens.

Further, the reduced size of the array structure may reduce signal losses due to scattering along the path traversed by an electromagnetic signal, such as through the lens material or through transmission lines of the array.

Figure 1:
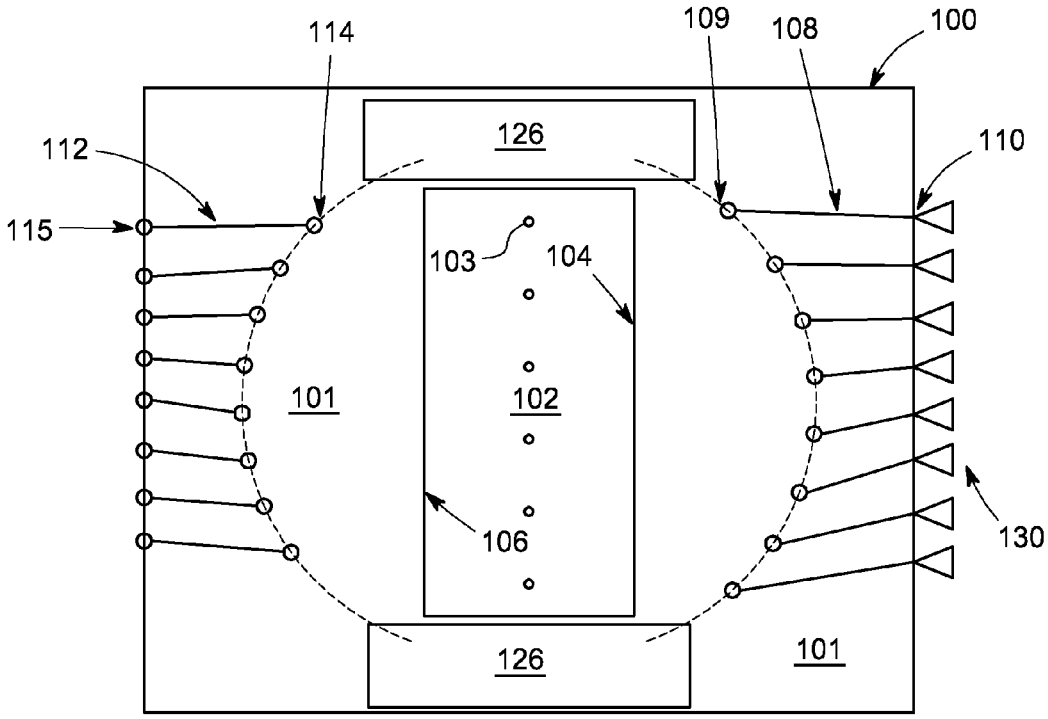
FIG. 1 depicts a top schematic view of an apparatus in accordance with some embodiments of the present invention.

FIG. 1 depicts a top schematic view of an apparatus 100 for receiving and transmitting electromagnetic signals in accordance with some embodiments of the present invention. As discussed above, the apparatus 100 may be an array structure, such as a Rotman lens or the like. As illustrated in FIG. 1, the apparatus 100 may include a positive refractive index (PRI) medium 101. The PRI medium 101 may be formed of one or more of Duroid®, such as comprising polytetrafluoroethylene (PTFE) reinforced with glass microfibers, FR4, such as a glass-reinforced epoxy laminate, quartz, fused silica or other suitable positive refractive index materials. For example, the refractive index of the positive refractive index medium may range from about 1.0 to about 4.0. In some embodiments, the refractive index of the positive refractive index medium may be higher that about 4.0.

Inserted in the PRI medium 101 may be a negative refractive index (NRI) medium 102 having a first side 104 and a second side 106. The NRI medium 102 may operate as a lens portion of the apparatus 100. The NRI medium 102 may comprise one or more artificial or engineered materials, for example, such as comprising one or more features 103 disposed thereon or therein as illustrated in FIG. 1. Although drawn in FIG. 1 as a one-dimensional periodic pattern, the one or more features may be distributed throughout the NRI medium 102 in any suitable single or multi-dimensional pattern than may be periodic or random. For example, the one or more features 103 may include one or more of printed loops, printed probes, printed metallic inserts or the like. Exemplary features 103 may include one or more of split-ring resonators, capacitively coupled loops, or lumped elements. For example, the refractive index of the NRI medium 102 may range between about −0.5 to about −4.0. In some embodiments, the refractive index of the NRI medium can be greater than about −0.5, e.g., between about −0.5 to less than about 0.0. In some embodiment, the refractive index of the NRI medium can be less than about −4.0. The refractive index of the negative refractive index medium may vary as a function of the dimensions of the one or more printed loops, printed, probes, or printed metallic inserts. The negative refractive index medium 102 may vary in thickness between the first side 104 and second side 106. The negative refractive index medium may be constructed in any suitable manner, such as using printed metallic inserts or the like, or using nano-structure inserts or the like to obtain a desired crystal structure.

The first side 104 and the second side 106 of the negative refractive index medium may have any desired radius of curvature such that in combination with other aspects of the apparatus 100, a plurality of incident electromagnetic signals entering the phased array 130 from the same direction are focused through the negative refractive index to a single outlet as discussed below and illustrated in FIGS. 3-4. For example, the first side 104 and the second side 106 of the negative refractive index medium 102 may be a flat surface, making the NRI medium 102 a rectangular slab. Alternatively, each side 104, 106 may have other radii.

The apparatus 100 may include a plurality of first transmission lines 108, wherein each first transmission line 108 has a first end 109 extending towards the first side 104 of the negative refractive index medium 102, as illustrated in FIG. 1. Each first end 109 may be coupled to a printed antenna element or printed horn as discussed below and illustrated in FIG. 2B. Each first transmission line 108 may include a second end 110 that may be connected to an element of the radiating phased array 130. The number of first transmission lines 108 in the plurality may vary and their number represents the number of elements in the radiating phased array 130. Exemplary elements of the radiating phased array 130 may include printed-circuit elements, patches, dipoles, or horns. The plurality of first transmission lines 108 may vary in path length, such that in combination with other aspects of the apparatus 100 produce a phase front across the radiating phased array 130 to radiate a beam in the direction corresponding to the beam position defined at an input of the apparatus at its opposite side, defined by the beam ports 115.

A plurality of second transmission lines 112 may be disposed adjacent to the second side 106 of the negative refractive index medium 102. Each second transmission line 112 may have a second end 114 extending toward the second side 106 of the negative refractive index medium 102, as illustrated in FIG. 1. Each second transmission line 112 may include an opposing end which may represent the beam port 115. As discussed below each second transmission line 112 may include an antenna element or printed horn coupled to the second end 114 as discussed below and illustrated in FIG. 2B. The number of second transmission lines 112 in the plurality may vary and may represent the number of beams formed by the apparatus 100. The path length may vary among the plurality of second transmission lines such that in combination with other aspects of the apparatus 100, such as radius of curvature and the like discussed above, that a plurality of electromagnetic signals that are being transmitted via a plurality of beam ports 115, are incident on the plurality of second transmission lines 112 from the same direction, travel through the plurality of second transmission lines 112 exiting at each second end 114, and are refracted through the negative refractive index medium 102 to produce a distribution across input elements connected at first ends 109 of the plurality of first transmission lines 108. For example, input elements may include antenna elements or printed horns coupled to each of the first ends 109 of the first transmission lines 108, as discussed below and illustrated in FIG. 2B.

An electromagnetic bandgap material (EBG) 126 may be disposed on opposing ends of the negative refractive index medium 102 to absorb stray electromagnetic signals which enter the negative refractive index medium 102 through the first or second sides 104, 106 of the negative refractive index medium 102. The electromagnetic bandgap material 126 may be disposed in a cut out region of the PRI medium 101, as illustrated in FIG. 1. For example, stray electromagnetic signals may include any electromagnetic signals that enter the negative refractive index medium 102 along the first or second transmission lines 108, 112, for example via printed antenna elements or printed horns coupled to the first or second transmission lines 108, 112 as discussed below, that may not be directed towards a desired propagation direction. Stray electromagnetic signals from the plurality of electromagnetic signals that may not be directed towards the common second transmission line 112 may be absorbed by the electromagnetic bandgap material 126. For example, absorption by the electromagnetic bandgap material may limit stray electromagnetic signals from reaching the incorrect transmission line, thus increasing signal noise and like. The electromagnetic bandgap material 126 may comprise one or more sizes to operate over a wide bandwidth. Exemplary configurations that may be used for the electromagnetic bandgap structure include one or more of mushroom-like patch array connected to a ground plane by conducting vias, patch arrays without conducting vias, or other suitable EBG configurations.

Figure 2A:
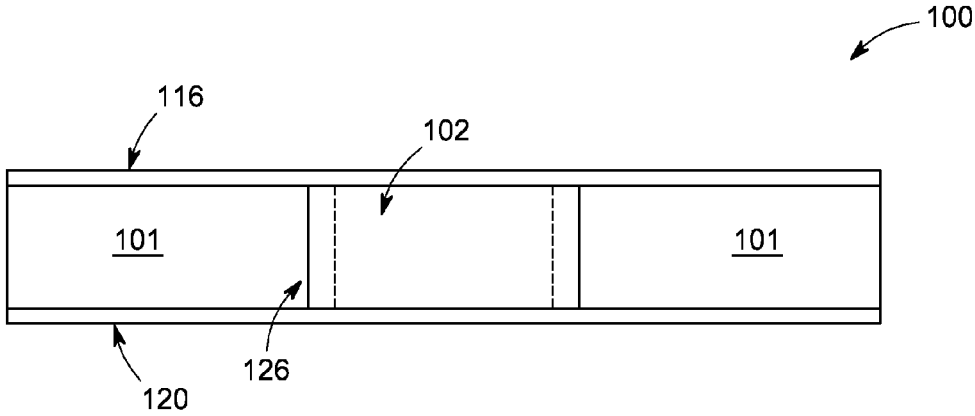
FIG. 2A depicts a schematic side view in cross-section of an apparatus in accordance with some embodiments of the present invention.
Figure 2B:
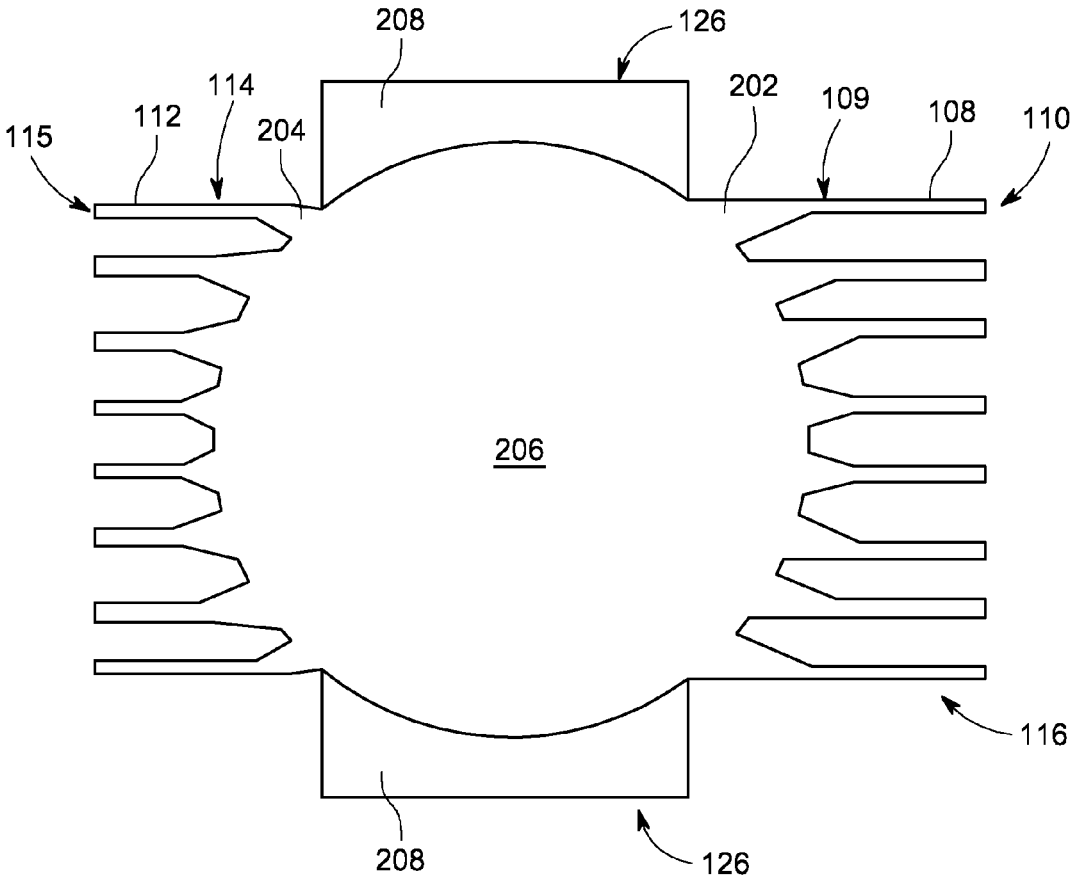
FIG. 2B depicts a top schematic view of a first plate and electromagnetic bandgap material in accordance with some embodiments of the present invention.
Figure 2C:
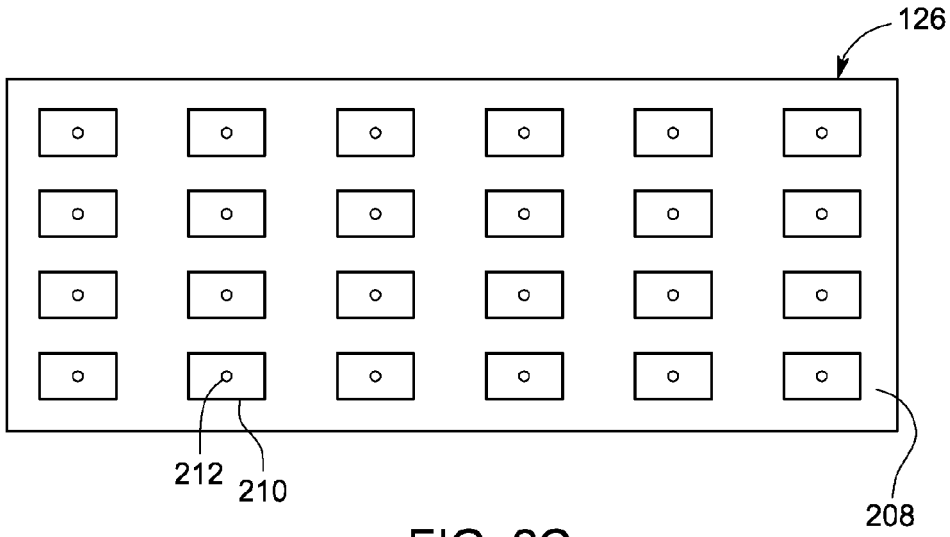
FIG. 2C depicts a top schematic view of an electromagnetic bandgap material in accordance with some embodiments of the present invention.

As illustrated in cross section view in FIG. 2A, the apparatus 100 may include a first plate 116 and a second plate 120, wherein the PRI medium 101 and the NRI medium 102 are disposed between the first and second plates 116, 120. Further, as illustrated in FIG. 2A-B, the electromagnetic bandgap material 126 may be disposed on opposing ends (e.g., ends opposing the first and second transmission lines 108, 112 as illustrated in FIG. 2B) of the central region 206 and at least partially between the first and second plates 116, 120. The pluralities of first and second transmission lines 108, 112 and pluralities of first and second printed horns (discussed below) may be formed by the first plate 116. The first plate 116 may be a continuous surface of metallic or conducting material having a geometry as described below. For example, as illustrated in FIG. 2B, the first plate 116 may be shaped in the form of first and second transmission lines 108, 112. For example, the first plate 116 may include a plurality of first printed horns 202, where each first printed horn 202 may be coupled to a corresponding first end 109 of one of the plurality of first transmission lines 108. Similarly, the first plate 116 may include a plurality of second printed horns 204, where each second printed horn 204 may be coupled to a corresponding second end 114 of one of the plurality of second transmission lines 112. The first and second printed horns 202, 204 may be coupled to a central region 206 of the first plate 116. For example, the central region 206 may be disposed above the NRI medium 102, the PRI medium 101 and coplanar with or slightly higher or lower than the upper surface 208 of the electromagnetic bandgap material 126. The electromagnetic bandgap (EBG) material 126 with an upper surface 208 (illustrated in FIG. 2B) may be utilized to absorb stray electromagnetic signals propagating through the NRI medium 102 and PRI medium 101. As illustrated in FIG. 2C, the upper surface 208 of the EBG material 126 may be patterned, for example, such as including one or more printed patches 210 situated above a ground plane (e.g., second plate 120) and connected to the ground plane with a pin or via 212. The printed patches may be patterned as squares (as illustrated in FIG. 2C), hexagons, or other shapes. Although illustrated in FIG. 2C as having the same dimensions, the one or more printed patches 210 may have the same or varying dimensions. For example, in some embodiments, at least one of the one or more printed patches may have a different dimension than at least another of the one or more printed patches.

The second plate 120 may be separated from the first plate 116 by the PRI medium 101 and NRI medium 102. The second plate 120 may be a continuous surface of metallic or conducting material. The first and second plates 116, 120 may comprise one or more of aluminum (Al), gold (Au), copper (Cu), or the like. While illustrated as rectangular in FIG. 1, the first and second plates 116, 120 may be any suitable outside shape, such as square, circular, polyhedron, irregularly shaped, or the like.

Figure 3A:
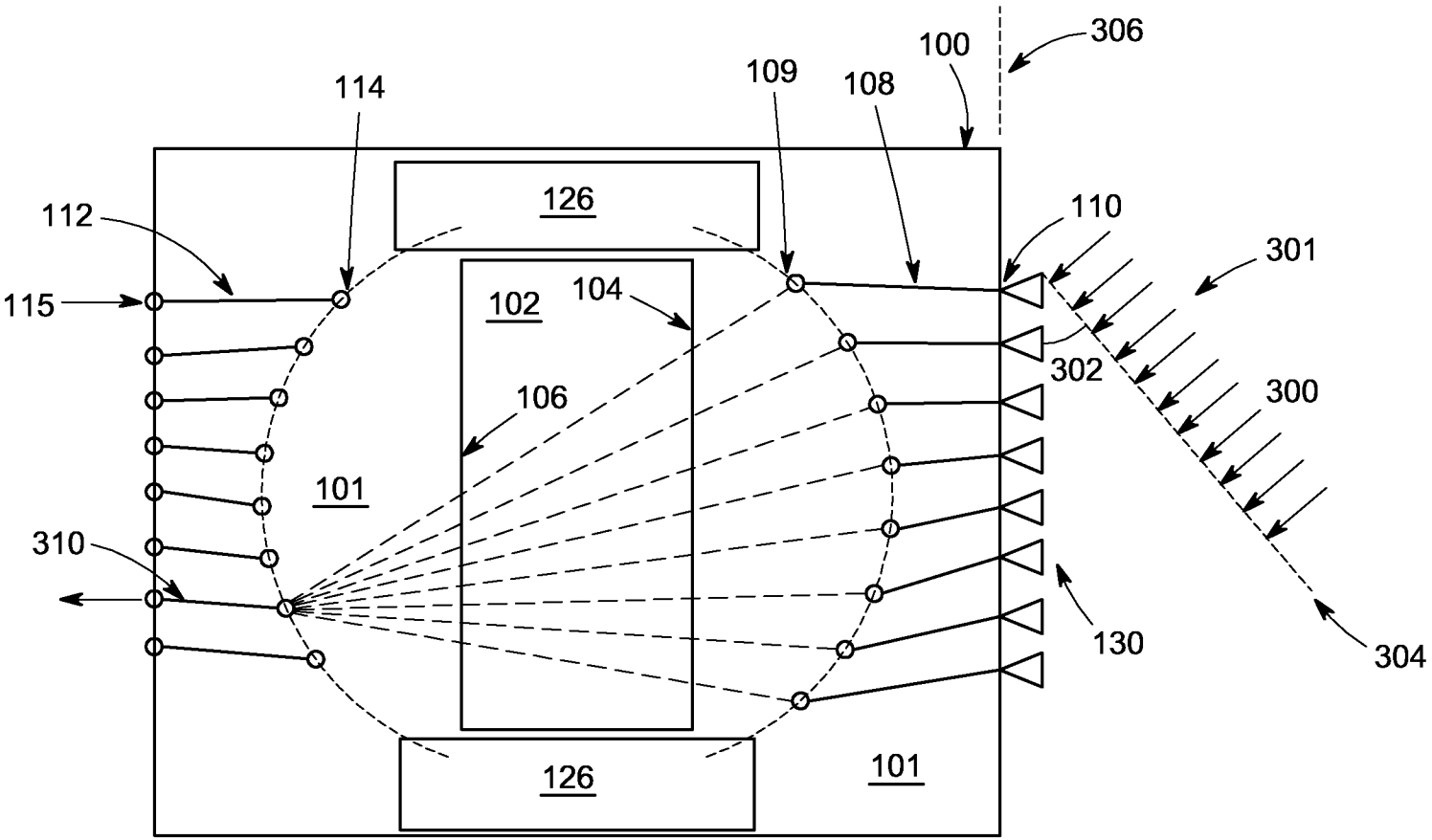
FIGS. 3A-B depict top schematic views of an apparatus for receiving incident electromagnetic waves in accordance with some embodiments of the present invention.
Figure 3B:
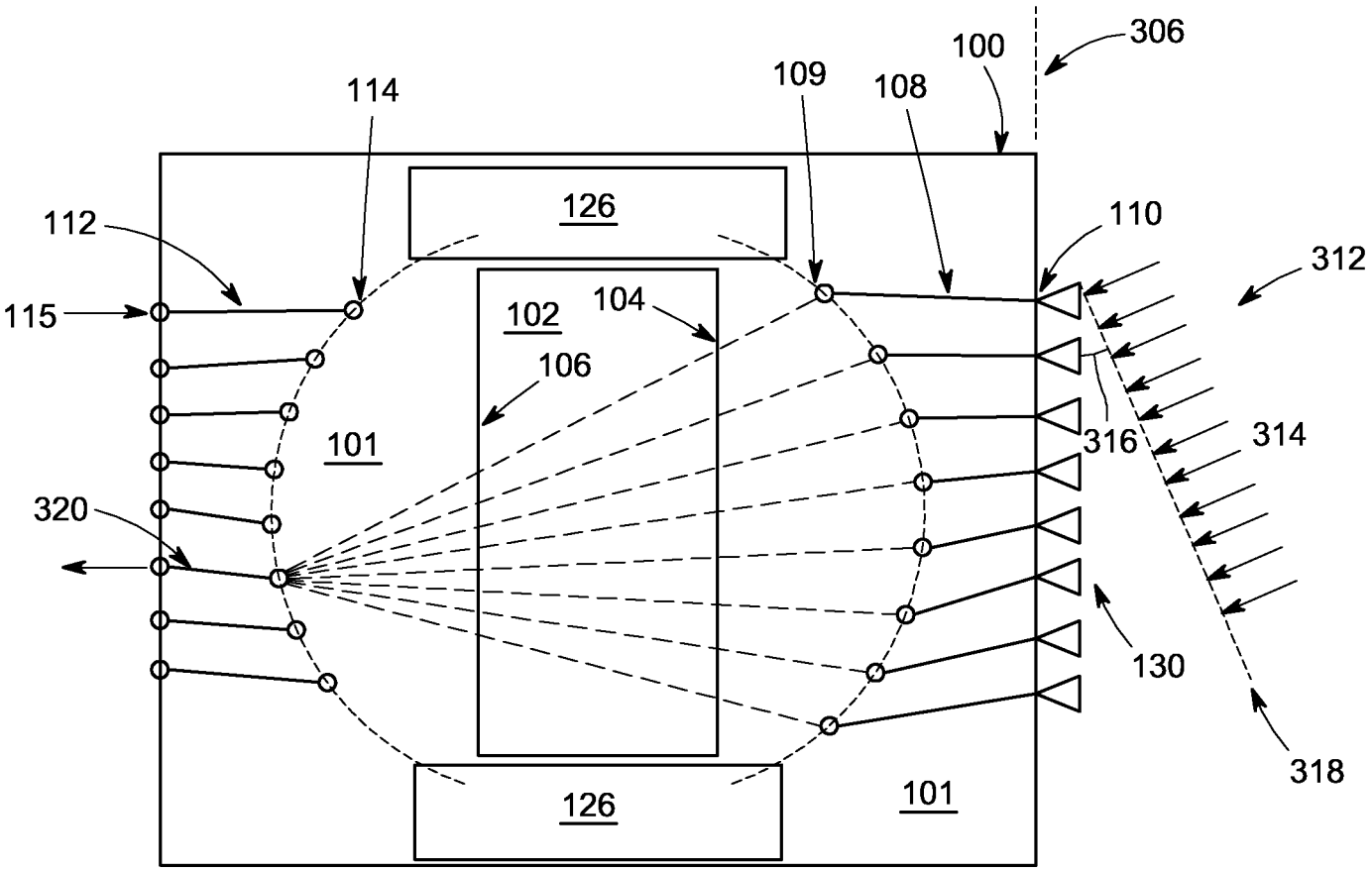
Figure 4A:
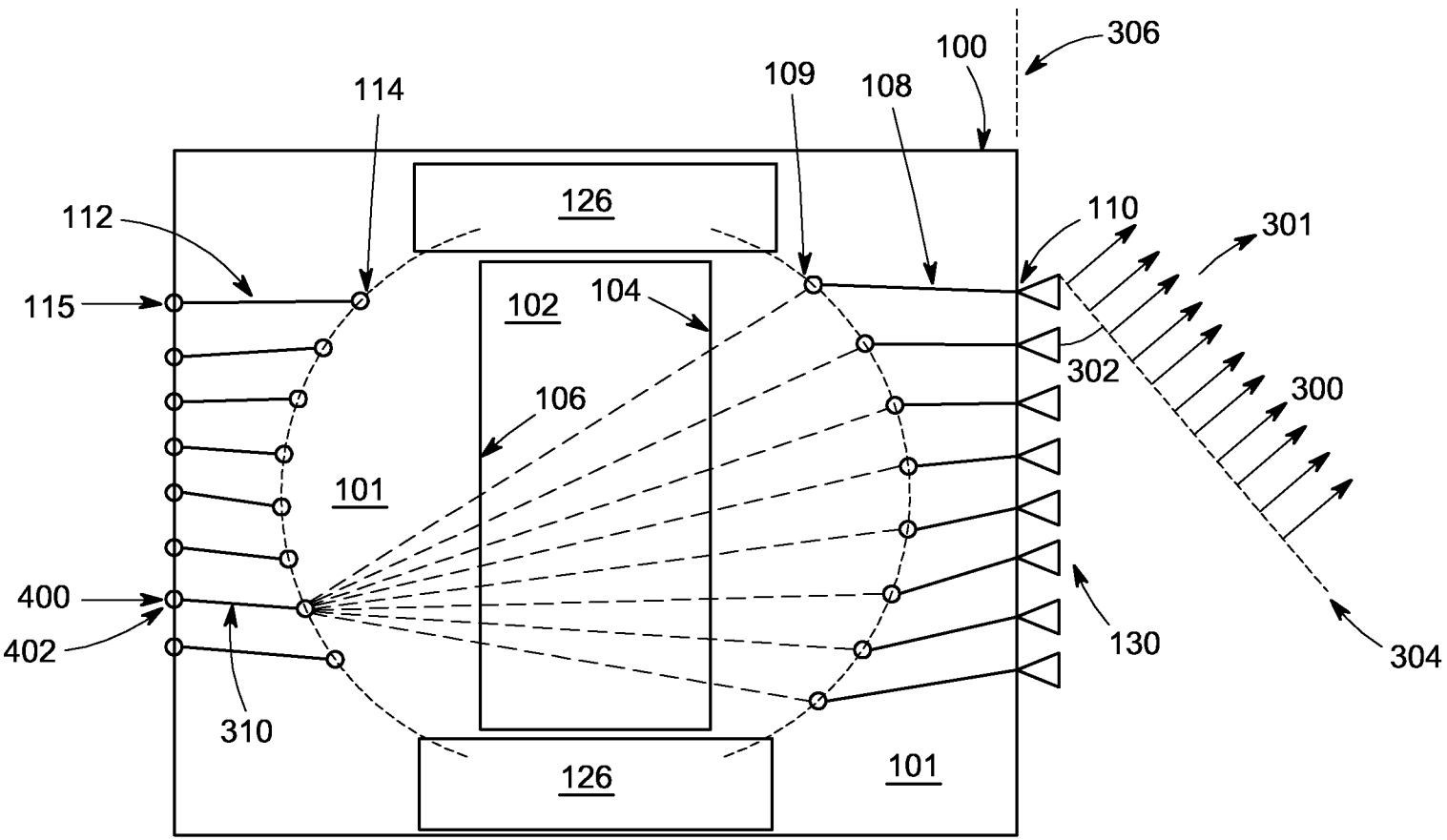
FIG. 4A-B depict top schematic views of an apparatus for transmitting electromagnetic waves in accordance with some embodiments of the present invention.
Figure 4B:
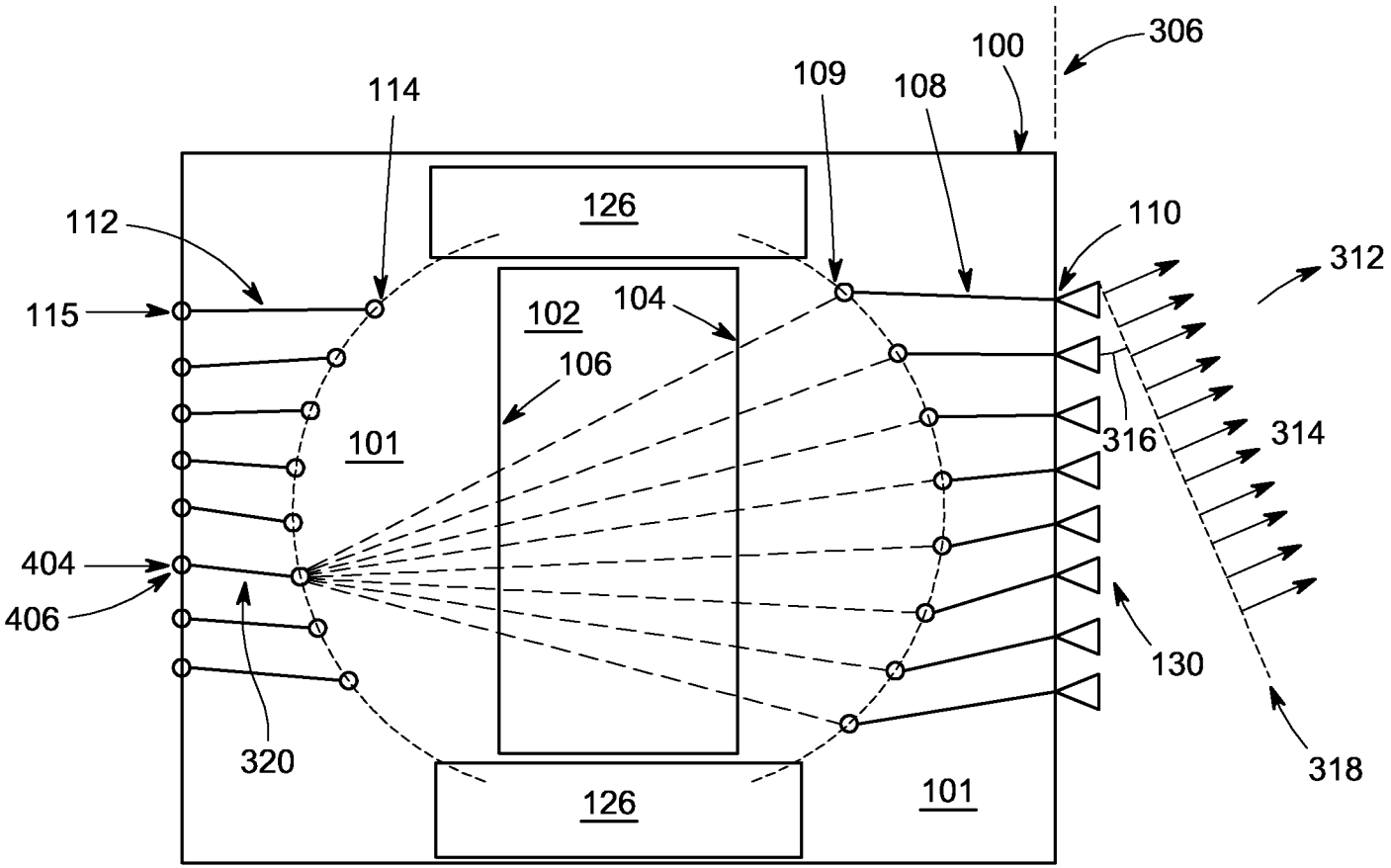

The apparatus 100 may be used to receive or transmit electromagnetic signals, as illustrated in FIGS. 3-4. For example, FIGS. 3A-B illustrate embodiments of the apparatus 100 where a plurality of electromagnetic signals is received by the plurality of first transmission lines 108 connected to the receiving phased array 130. Similarly, FIGS. 4A-B illustrate embodiments of the apparatus 100 where an electromagnetic signal is transmitted by the plurality of first transmission lines 108 connected to the radiating phased array 130. As used herein, an electromagnetic signal may refer to continuous or modulated waves or wave packets, or the like.

For example, FIG. 3A illustrates the apparatus 100 having a plurality of electromagnetic signals 300 incident on the plurality of first transmission lines 108. As illustrated, each electromagnetic signal 300 may be travelling in a first direction 301, where the first direction 301 may be defined by an angle 302 between a signal front 304 and a plane 306 that contains the phased array 130. The signal collimates along a first one 310 of the plurality of second transmission lines 112. As partially illustrated in FIG. 3A, the plurality of electromagnetic signals 300 travels through the PRI medium 101 along the plurality of first transmission lines 108 and the plurality of first printed horns 202 to the first side 104 of the NRI medium 102. The plurality of electromagnetic signals 300 passes through the negative refractive index medium 102 and exits through the second side 106 of the negative refractive index medium 102 into the PRI medium 101 along the first one 310 of the plurality of second transmission lines 112 and corresponding second printed horn 204 to one beam port 115 coupled to the opposing end of the first one 310 of the plurality of second transmission lines 112.

For example, in some embodiments, the plurality of electromagnetic signals 300 may comprise a first plurality of first electromagnetic signals and a second plurality of second electromagnetic signals, wherein each first electromagnetic signal has a first frequency and is travelling in the first direction 301 and each second electromagnetic signal has a second frequency different from the first frequency and is travelling in the first direction 301. In such embodiments, both the first plurality of first electromagnetic signals and the second plurality of electromagnetic signals are focused through the negative refractive index medium 102 to a common second transmission lines 112, such as the first one 310 of the plurality of second transmission lines 112, as illustrated in FIG. 3A.

In some embodiments, a plurality of electromagnetic signals may be incident on the apparatus from a second direction 312 different from the first direction 301. For example, as illustrated in FIG. 3B, the apparatus 100 may have a plurality of second electromagnetic signals 314 incident on the apparatus from the second direction 312. As illustrated, each second electromagnetic signal 314 may be travelling in the second direction 312, where the second direction 312 may be defined by an angle 316 between a signal front 318 and the plane 306 that contains the phased array 130. The signal collimates at a second one 320 of the plurality of second transmission lines 112. As illustrated in FIG. 3B, the plurality of second electromagnetic signals 314 enters the PRI medium 101 along the plurality of first transmission lines 108 and plurality of first printed horns 202 to the first side 104 of the negative refractive index medium 102. The plurality of electromagnetic signals 314 passes through the negative refractive index medium 102 and exits through the second side 106 of the negative refractive index medium 102 into the PRI medium 101 along the second one 320 of the plurality of second transmission lines and corresponding second printed horn 204 to one beam port 115 coupled to the opposing end of the second one 320 of the plurality of second transmission lines 112.

For example, in some embodiments, because of the first direction 301 may be different from the second direction 312, the plurality of electromagnetic signals 300 may be focused to the first one 310 of the plurality of second transmission lines 112 and the plurality of second electromagnetic signals 314 may be focused to the second one 320 (different from the first one 310) of the plurality of second transmission lines 112. For example, focusing may be dependent on direction (e.g., the first and second directions 301, 312) and independent of frequency. For example, each electromagnetic signal 300 and each second electromagnetic signal 314 may have the same frequency or different frequencies, and the behavior illustrated in FIGS. 3A-B and discussed above may still hold.

The apparatus 100 may be used to transmit electromagnetic signals, as illustrated in FIG. 4A-B. For example, as illustrated in FIG. 4A, a first electromagnetic signal 400 may enter the first one 310 of the plurality of second transmission lines 112 at an end 402 (e.g., at a beam port or the like). The first electromagnetic signal 400 may travel through the PRI medium 101 along the first one 310 of the plurality of second transmission lines 112 and a corresponding one of the plurality of second printed horns 204 and exits the PRI medium 101 into the second side 106 of the negative refractive index medium 102. The first electromagnetic signal 400 may be dispersed by the NRI medium 102 into the plurality of electromagnetic signals 300, which exit through the first side 104 of the NRI medium 102 into the PRI medium 101 along the plurality of first transmission lines 108 and corresponding plurality of first printed horns 202. The plurality of electromagnetic signals 300 can exit the array through the radiating phased array elements 130 that may be coupled to each second end 110 of each of the plurality of first transmission lines 108 travelling in the first direction 301 defined by the angle 302 between the plane of the radiating phased array 130 and the plane 304 of the radiated signals.

In some embodiments, the first electromagnetic signal 400 may comprise a first electromagnetic signal at a first frequency and a second electromagnetic signal at a second frequency different from the first frequency and the plurality of electromagnetic signals 300 may comprise a first plurality of electromagnetic signals at the first frequency and a second plurality of electromagnetic signals at the second frequency.

For example, as illustrated in FIG. 4B, a second electromagnetic signal 404 may enter the second one 320 of the plurality of second transmission lines 112 at an end 406. The second electromagnetic signal 404 may travel through the PRI medium 101 along the second one 320 of the plurality of second transmission lines 112 and corresponding one of the plurality of second printed horns 204 and exit the PRI medium 101 into the second side 106 of the negative refractive index medium 102. The second electromagnetic signal 404 may be dispersed by the NRI medium 102 into the plurality of second electromagnetic signals 314, which exit through the first side 104 of the medium 102 into the PRI medium 101 along the plurality of first transmission lines 108 and corresponding plurality of first printed horns 202. The plurality of second electromagnetic signals 314 can exit the apparatus through the radiating phased array elements that terminate at each second end 110 of each of the plurality of first transmission lines 108 travelling in the second direction 312 defined by the angle 316 between the plane of the radiating phased array 130 and the plane 318 of the radiated signals. For example, the first electromagnetic signal 400 and the second electromagnetic signal 404 may have the same frequency or different frequencies, and the behavior illustrated in FIGS. 4A-B and discussed above may still hold.

Various elements, devices, modules and circuits are described above in associated with their respective functions. These elements, devices, modules and circuits are considered means for performing their respective functions as described herein.

While the foregoing is directed to embodiments of the present invention, other and further embodiments of the invention may be devised without departing from the basic scope thereof, and the scope thereof is determined by the claims that follow.

The invention claimed is:

1. An apparatus for receiving and transmitting signals, comprising:

a positive refractive index medium;

a negative refractive index medium having a first side and a second side disposed in the positive refractive index medium;

a plurality of first transmission lines, each first transmission line having a first end extending toward the first side of the negative refractive index medium; and a plurality of second transmission lines, each second transmission line having a second end extending toward the second side of the negative refractive index medium, wherein a plurality of electromagnetic signals, each electromagnetic signal travelling in a first direction, enters the positive refractive index medium and travels along the plurality of first transmissions lines and exits into the first side of the negative refractive index medium, passes through the negative refractive index medium and exits through the second side of the negative refractive index medium into the positive refractive index medium along a first one of the plurality of second transmission lines.

2. The apparatus of claim 1, wherein the negative refractive index medium further comprises:

one or more features comprising one or more of printed loops, printed probes, or printed metallic inserts, wherein the one or more features are periodically or randomly disposed in the negative refractive index medium.

3. The apparatus of claim 1, further comprising:

a electromagnetic bandgap material disposed on opposing ends of the negative refractive index medium to absorb stray electromagnetic signals which enter the negative refractive index medium through the first or second side of the negative refractive index medium.

4. The apparatus of claim 3, wherein the electromagnetic bandgap material comprises one or more printed patches, wherein each printed patch is connected to the second plate by a corresponding via.

5. The apparatus of claim 4, wherein at least one of the one or more printed patches has a different dimension than at least another of the one or more printed patches.

6. The apparatus of claim 1, further comprising:

a plurality of first printed horns, each first printed horn coupled to a corresponding first end of one of the plurality of first transmission lines; and a plurality of second printed horns, each second printed horn coupled to a corresponding second end of one of the plurality of second transmission lines.

7. The apparatus of claim 6, further comprising:

a first plate having the plurality of first transmission lines, the plurality of first printed horns, the plurality of second transmission lines, and the plurality of second printed horns formed in the first plate; and a second plate, wherein the positive refractive index medium is disposed between the first and second plates.

8. The apparatus of claim 6, wherein the first and second plates comprise one or more of aluminum (Al) copper (Cu), or gold (Au).

9. The apparatus of claim 1, wherein the plurality of electromagnetic signals comprises a first plurality of first electromagnetic signals and a second plurality of second electromagnetic signals, wherein each first electromagnetic signal having a first frequency and travelling in the first direction and wherein each second electromagnetic signal having a second frequency different from the first frequency and travelling in the first direction.

10. The apparatus of claim 1, wherein a plurality of second electromagnetic signals, each second electromagnetic signal travelling in a second direction different from the first direction, enters the positive refractive index medium and travels along the plurality of first transmissions lines up to the first side of the negative refractive index medium, passes through the negative refractive index medium and exits through the second side of the negative refractive index medium into the positive refractive index medium along a second end of a second one of the plurality of second transmission lines.

11. The apparatus of claim 10, wherein each electromagnetic signal and each second electromagnetic signal have the same frequency.

12. The apparatus of claim 1, wherein a first electromagnetic signal which enters the positive refractive index medium along the first one of the plurality of second transmission lines and exits the positive refractive index medium into the second side of the negative refractive index medium, pass through the negative refractive index medium, and exits through the first side of the negative refractive index medium into the positive refractive index medium along the plurality of first transmission lines, can exit the apparatus as the plurality of electromagnetic signals, each electromagnetic signal travelling in the first direction.

13. The apparatus of claim 12, wherein the first electromagnetic signal comprises a first electromagnetic signal at a first frequency and a second electromagnetic signal at a second frequency different from the first frequency and wherein the plurality of electromagnetic signals comprises a first plurality of electromagnetic signals at the first frequency and a second plurality of electromagnetic signals at the second frequency.

14. The apparatus of claim 12, wherein a second electromagnetic signal which enters the positive refractive index medium along a second one of the plurality of second transmission lines and exits the positive refractive index medium into the second side of the negative refractive index medium, pass through the negative refractive index medium, and exits through the first side of the negative refractive index medium into the positive refractive index medium along the plurality of first transmission lines, can exit the apparatus as a plurality of second electromagnetic signals travelling in a second direction different from the first direction.

15. The apparatus of claim 14, wherein the first electromagnetic signal and the second electromagnetic signal have the same frequency.

16. An apparatus for receiving and transmitting signals, comprising:

a first plate;

a second plate;

a positive refractive index medium disposed between the first and second plates;

an negative refractive index medium having a first side and a second side disposed in the positive refractive index medium;

a electromagnetic bandgap material disposed in the positive refractive index medium on opposing ends of the negative refractive index medium to absorb stray electromagnetic signals which enter the negative refractive index medium through the first or second side of the negative refractive index medium;

a plurality of first transmission lines formed in the first plate, each first transmission line having a first end extending, toward the first side of the negative refractive index medium;

a plurality of first printed horns, each first printed horn coupled to a corresponding first end of one of the plurality of first transmission lines;

a plurality of second transmission lines, each second transmission line having a second end extending toward the second side of the negative refractive index medium; and a plurality of second printed horns, each second printed horn coupled to a corresponding, second end of one of the plurality of second transmission lines, wherein a plurality of electromagnetic signals, each electromagnetic signal travelling in a first direction, enters the positive refractive index medium and travels along the pluralities of first transmissions lines and first printed horns and exits into the first side of the negative refractive index medium, passes through the negative refractive index medium and exits through the second side of the negative refractive index medium into the positive refractive index medium along a first one of the plurality of second printed horns and a corresponding first one of the plurality of second transmission lines.

17. The apparatus of claim 16, wherein a plurality of second electromagnetic signals, each second electromagnetic signal travelling in a second direction different from the first direction, enters the positive refractive index medium along the plurality of first transmissions lines and exits along the plurality of first printed horns into first side of the negative refractive index medium, passes through the negative refractive index medium and exits through the second side of the negative refractive index medium into the positive refractive index medium along a second one of the plurality of second printed horns and a corresponding second one of the plurality of second transmission lines.

18. The apparatus of claim 16, wheren the negative refractive index medium further comprises:

one or more features comprising one or more of printed loops, printed probes, or printed metallic inserts, wherein the one or more features are periodically or randomly disposed in the negative refractive index medium.

19. The apparatus of claim 16, wherein the electromagnetic bandgap material comprises one or more printed patches, wherein each printed patch is connected to the second plate by a corresponding via.

20. The apparatus of claim 19, wherein at least one of the one or more printed patches has a different dimension than at least another of the one or more printed patches.

* * * * *